US005840048A

United States Patent [19]

Cheng

[11] Patent Number: 5,840,048

[45] Date of Patent: Nov. 24, 1998

[54] SKIN BRUSH MASSAGE METHOD

[75] Inventor: Chia-Yu Cheng, Shanghai, Switzerland

[73] Assignee: Jun Sui Kan Sei Cosmetics International Limited, Virgin Islands (Br.)

[21] Appl. No.: 590,784

[22] Filed: Jan. 24, 1996

[51] Int. Cl.[6] ..... H61H 9/00; A61N 1/00; A61H 21/00

[52] U.S. Cl. ..... 601/18; 128/24.1; 604/22; 601/157; 606/41

[58] Field of Search ..... 601/18, 15, 118, 601/1, 157, 121; 606/41–42; 607/2, 115–116, 108–111; 128/24.1, 24 A, 24.2, 24.3, 24.4, 24.5, 804, 303.14, 303.17, 303.13, 303.18, 801, 421, 56, 60, 44–46; 604/22, 20

[56] References Cited

U.S. PATENT DOCUMENTS

| | | | |
|---|---|---|---|
| 3,489,138 | 1/1970 | Lifschitz | 601/18 |
| 3,585,991 | 6/1971 | Balamuth | 601/18 |
| 3,841,321 | 10/1974 | Albach et al. . | |
| 4,249,521 | 2/1981 | Gueret | 15/110 |
| 4,404,965 | 9/1983 | Waits et al. | 606/157 X |
| 4,860,392 | 8/1989 | Gardenier et al. | 606/157 |
| 4,908,016 | 3/1990 | Thomsen | 5/450 |
| 5,086,788 | 2/1992 | Castel et al. | 606/41 X |
| 5,140,978 | 8/1992 | Sirninger | 601/18 |
| 5,409,011 | 4/1995 | Alexeev et al. | 128/734 |
| 5,484,387 | 1/1996 | Pitzen | 607/109 |

OTHER PUBLICATIONS

"Shiatsu", The Complete Book of Massage, Maxwell–Hudson, Clare, Dorling KindersbeyLtd., London, 1988,pp. 114–119.

*Primary Examiner*—Michael Buiz
*Assistant Examiner*—Nancy Mulcare
*Attorney, Agent, or Firm*—Carter & Schnedler

[57] ABSTRACT

A method of treating the skin by specific massage procedure, using one or more brushes. The method comprises the steps of providing a facial and a body massaging brush. A clockwise brush massage is applied to stimulate specific designated areas of the body for a predetermined period of time. The brush massage is performed in a specific sequence of the designated areas in compliance with a network of acupuncture points. The method of this invention improves blood circulation and simultaneously provides an exfoliation of skin tissue.

8 Claims, 4 Drawing Sheets

SKIN BRUSH MASSAGE METHOD

TECHNICAL FIELD

The present invention relates to a method of treating the skin by a specific massage procedure, using one or more brushes, and where the procedure is performed in a specific sequence of designated areas in compliance with a network of acupuncture points whereby to improve blood circulation and simultaneously provide an exfoliation of skin tissue.

BACKGROUND ART

The method of treating the skin of the present invention is a novel method taking into consideration acupuncture and shiatzu methodologies which have been practiced for thousands of years and particularly in the Orient. The present method is founded in shiatzu therapy and provides superior effects in that it stimulates the same network of acupuncture points on the body, without the use of needles, and instead of using finger pressure, as is the case with shiatzu, the present method utilizes brushes which have been fabricated to improve blood circulation and light exfoliation of skin tissue. The brushes which are utilized in the present technique stimulates the key acupuncture points of the body and the face while deep cleansing the skin and thereby enhancing a soft or light skin exfoliation. By using creams which are entirely made from natural products and from exotic plants this exfoliation is further enhanced.

SUMMARY OF INVENTION

It is a feature of the present invention to provide a method of treating the skin by a specific massage procedure and using brushes which results in a younger looking skin would improve skin tint and coloration and particularly which provides an improvement of the facial skin texture.

Another feature of the present invention is to provide a method of treating the skin which provides a further physical benefit in rebalancing the energy within the body by stimulating key points of the body based on well known acupuncture techniques.

Another feature of the present invention is to provide a method of treating the skin which permits the user to relax and thereby favorising meditation. Another feature of the present invention is to provide a method of treating the skin and which is capable of relaxing tense muscles thereby alleviating tension and favorising a balanced blood flow throughout the body.

Another feature of the invention is that treatment can be combined with the normal hygiene habits and thus when bathing or showering and this combination results in a time saving and a habit forming to treat oneself.

Another feature of the present invention is to provide a method of treating the skin by a specific massage procedure whereby to preserve ones good physical health and energy distribution throughout the body while stimulating the well known 657 key acupuncture points of the body. Some wise orientals had observed thousands of years ago that physical disorders have an effect or a relationship with certain precise points on the surface of the human body. They also had observed that certain of these points were related between each other and consequently they established a chart consisting of a network of lines which connected these various points and they segmented this chart with 24 meridians, 12 relating to each half of the human body. To these 24 meridians they added 2 meridians relating to coordination and classified these as the meridian of Conception and the meridian Regulator. According to Chinese and Japanese experts, it is through the meridians that the energy circulates throughout the human body. If the energy is out of balance, it is possible to re-establish the balance by practicing acupuncture and shiatzu. The method of treating the skin by the specific massage procedure of the present invention is another manner in obtaining this equilibrium or balance of energy in the human body.

According to the above features from a broad aspect, the present invention provides a method of treating the skin by a specific massage procedure using one or more brushes. The method comprises the steps of providing a facial and body massaging brush. A clockwise brush massage is applied to stimulate specific designated areas of the body and face for a predetermined period of time. This clockwise brush massage is performed in a specific sequence of designated areas and in compliance with a network of acupuncture points. The method improves blood circulation and simultaneously provides a exfoliation of skin tissue.

BRIEF DESCRIPTION OF DRAWINGS

Preferred embodiments of present invention will be described with reference to the accompanying drawings in which.

DESCRIPTION OF PREFERRED EMBODIMENTS

Figure 1:
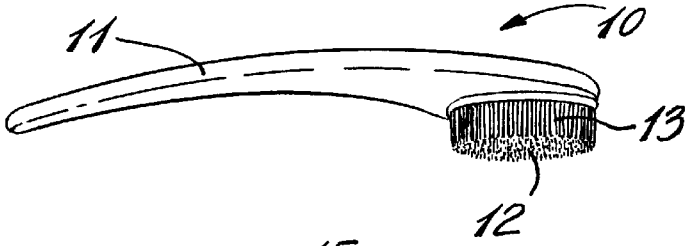
FIG. 1 is a perspective view of a facial brush as utilized to apply the massage to designated areas of the skin.

Referring now to the drawings particularly FIG. 1 there is shown a brush 10 for use in massaging sensitive areas such as the face. The brush is provided with a handle 11 and a massaging surface 12 which is comprised of a plurality of soft nylon bristles 13 closely spaced to one another.

Figure 2:
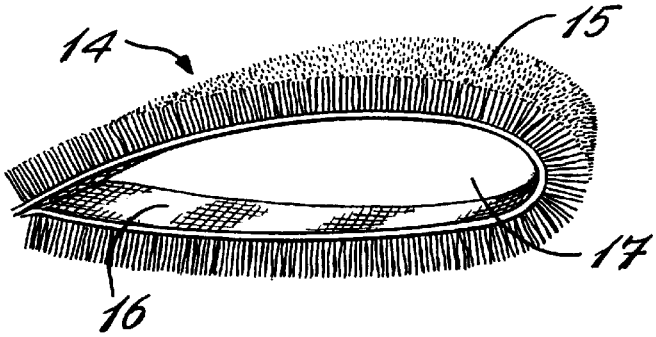
FIG. 2 is a perspective view of a further brush utilized to apply a massage to other designated areas of the skin.

FIG. 2 shows a different type of brush 14 which is utilized to brush the skin in less sensitive areas of the body. That brush is provided by a plurality of stiff twine-like bristles 15 which are secured to a backing fabric 16 which is looped to create a handle hole 17 in which the hand may be positioned. These large bristles 15 have the effect of stimulating the skin while providing a pressure massage similar to that of shiatzu techniques whilst at the same time causing an exfoliation of dead skin tissues. With these two brushes one is capable of massaging designated areas of the body following a precise technique or treatment as will be described later.

It is pointed out that the treatment can be performed with the body immersed in water such as in a bathtub, or under the shower where the body is subjected to a continuous flow of water as this enhances the skin exfoliation and the massage therapy.

In a preferred manner of treatment of the skin with the massage technique of the present invention, although not an exclusive manner, the treatment to the skin is effectuated using the specific soaps, ointments and tonics, over all of the body and the face while immersing the body in the bathtub or under the shower. These soaps are also composed entirely of natural products which are plant derivatives and these act on the first and the second skin layers. The soap can also be used on the scalp. A facial tonic is also provided and which is derived from marine algaes to act on the second skin layer of the face which is very delicate. By using the brush of FIG. 1 the facial tonic improves the skin texture and tone.

An ointment is utilised on the body after the skin has been dried and permits a balanced hydration of the skin and eliminates irritation of the second skin layer caused by the use of the brushes, and this is particularly useful during the first few weeks of treatment where the skin is more sensitive to this treatment.

Figure 3:
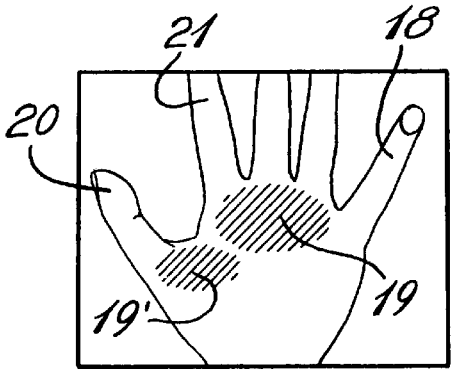
FIG. 3 is a schematic view of showing the areas of the hand where a clockwise brush massage is performed, FIGS. 4 *a–b–c* are schematic views showing specific areas of the head and neck where a brush massage is to be applied.

With reference to FIGS. 3 to 10 there will be described the manner in which the brush massage of the method of the present invention is effected. The massage is effected on specific designated areas of the body and face for a predetermined period of time following a specific sequence of the designated areas in compliance with a network of acupuncture points. This specific sequence is illustrated by FIGS. 3 to 10 and these are also based on the meridian coordinates which were described earlier. The treatment is also performed by a clockwise rotation of the brushes on the designated areas. The user can feel the benefit of massaging certain key designated area by obtaining a heat sensation in the areas being massaged. The user also massages these areas where a heat sensation is felt during a longer period of time in order to re-establish the balance of energy in his body because the brush, as illustrated in FIG. 2, and covers the entire surface of the hand, during the brush massage, it covers several acupuncture points and it is up to the user, by concentration, to detect what specific area within the massage area he experiences a heat sensation in order to permit more concentrated massage in that specific area. It is recommended that this treatment be effected at all of the designated areas as shown in FIGS. 3 to 10 throughout a total time span of about 15 to 20 minutes. It is also recommended that the massage be given 4 times a week in order to obtain durable results and ideally everyday during bathing or showering. Referring to FIG. 3 there is shown a schematic representation of the hand. It is the hands that transmit the vital energy within the body. By practicing the method of the present invention on a regular basis the user determines quickly the amount of pressure that he should utilize on the brush and at specific areas on the body as it can vary between designated areas. If the user feels some resistance then he must apply more pressure in the designated area. As shown in FIG. 3 the first designated area is shown at 19 on the top surface of the hand and a second designated area shown at 19 (1) in the area of the muscle between the thumb 20 and the index finger 21.

Figure 4A:
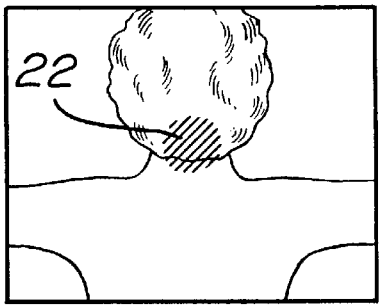
Figure 4B:
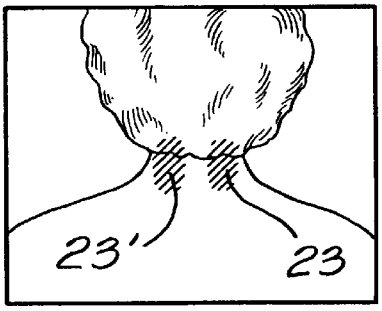
Figure 4C:
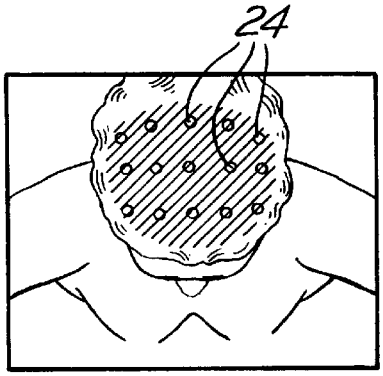

FIGS. 4*a* to 4*c* illustrate various designated areas of the head and neck. As shown in FIG. 4*a* the next massage area after the right and left hand has been massaged is to the base of the skull as shown by the designated area 22. As shown in FIG. 4*b* the next area is the muscles of the neck and particularly the large muscle that is situated between the base of the skull to the shoulder. These areas are illustrated at 23 and 23 (1) respectively. FIG. 4*c* illustrates various points 24 would to be massaged on the top of the head. As previously described, a soap may be placed on the head prior to this massage.

Figure 5A:
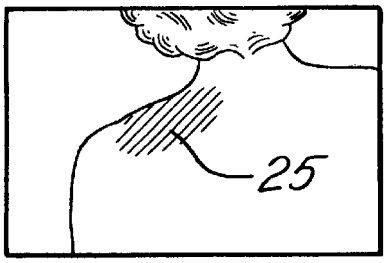
FIGS. 5*a* to 5*d* are schematic illustrations also showing specific areas where a brush massage is to be applied to the shoulders and the back of the human body.
Figure 5B:
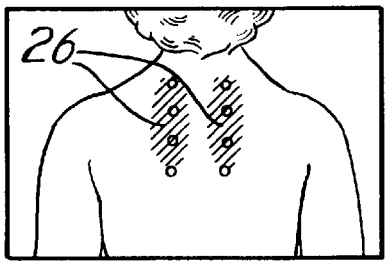
Figure 6B:
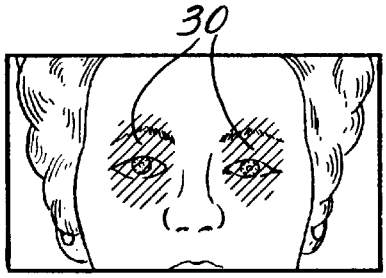
Figure 5C:
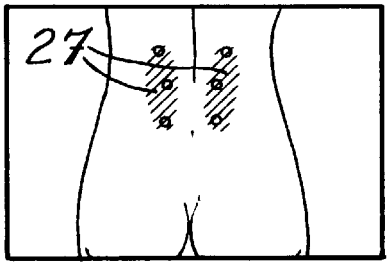
Figure 6C:
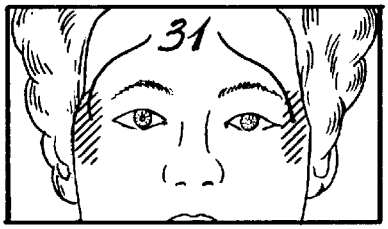
Figure 5D:
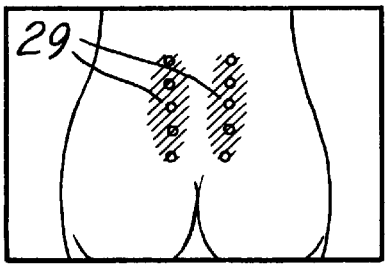
Figure 6D:
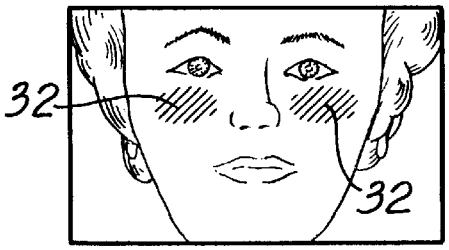
Figure 6E:
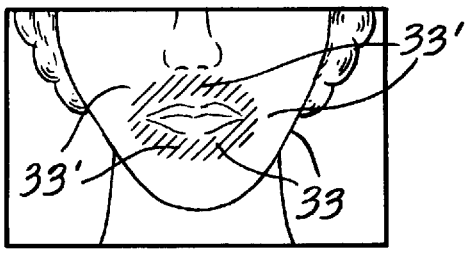

Referring to FIGS. 5*a* and 5*d* there is shown specific designated areas to massage the shoulders and the back. On opposed shoulders there are designated areas at 25 where the clockwise brush massage is to be effected. This area 25 is located on the top of the shoulder midway between the base of the neck and the shoulder and slightly to the back of the central shoulder muscle. The designated areas 26 as shown at FIG. 5*b* is that of the top of the back starting from the bottom of the designated area 26 to the top area. FIG. 5*c* designates at 27 the lower back area where the massage should be done from the top to the bottom of the area. FIG. 5*d* illustrates the designated area 28 to massage the bottom of the spinal cord.

Figure 6A:
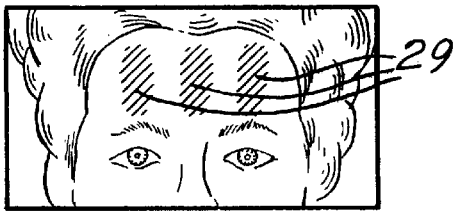
FIGS. 6*a* to 6*h* are schematic illustrations showing specific areas of the face and neck where a brush massage is to be applied.
Figure 6F:
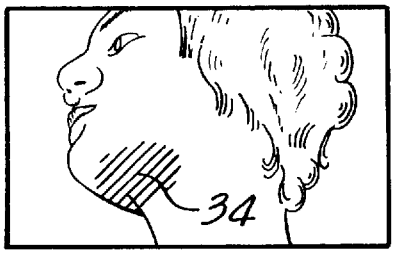
Figure 6G:
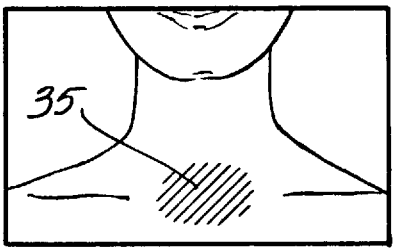

FIGS. 6*a* to 6*e* illustrates the massage areas for the face and neck. As shown in FIGS. 6*a* there are 3 designated areas 29 on the forehead, one over each eye and one central. The next designated area for a massage is around the eyes as shown at 30 and FIG. 6*b*. The treatment then proceeds to the temples as shown by the designated areas 31 and FIG. 6*c*. The cheek areas are then massaged shown at 32 and FIG. 6*d* and then the mouth area as designated at FIG. 6*e* by reference numeral 33. It is pointed out that these areas may contain various acupuncture points such as the points 33 (1) in the FIG. 6*e*, but these are not necessarily all shown in the accompanying drawings. FIG. 6*f* illustrates the designated areas 34 to massage the underside of the chin whilst FIG. 6*g* illustrates the neck and throat area 35. The next area for massage is the front and side of the neck as illustrated by the designated areas 36 in FIG. 6*h*.

Figure 7A:
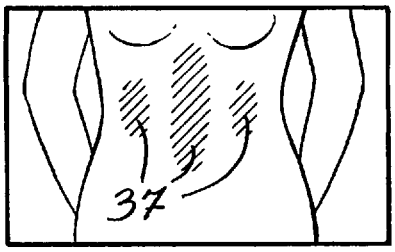
FIGS. 7*a* and 7*b* are schematic illustrations showing specific areas of where a brush massage is to be applied to the chest and abdomen of the human body.
Figure 7B:
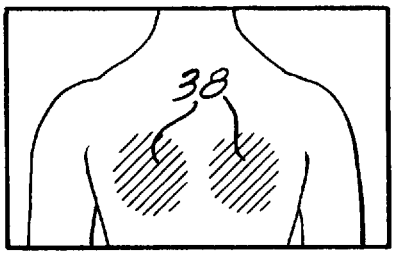

Referring now to FIGS. 7*a* and 7*b* there shown the designated areas 37 to massage the abdomen and areas 38 to massage the chest, shown respectively in these two Figures.

Figure 8A:
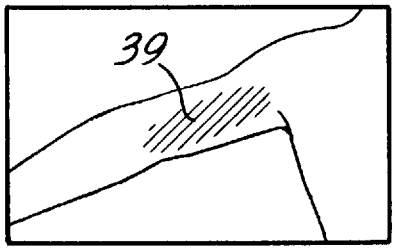
FIGS. 8*a* and 8*b* are specific illustrations of specific areas of the arm where a brush massage is to be applied.
Figure 6H:
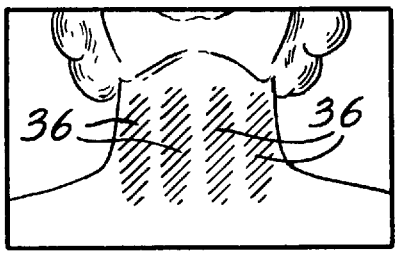
Figure 8B:
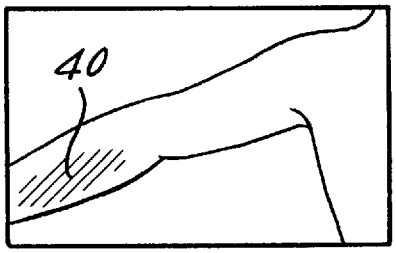

FIGS. 8*a* and 8*b* also designate the area 39 which is the underarm to elbow massage area and area 40 which designates a forearm.

Figure 9A:
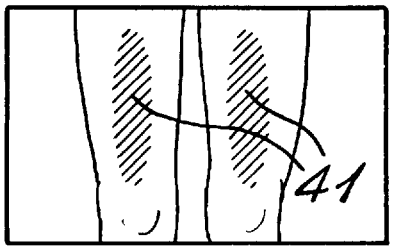
FIGS. 9*a* to 9*c* are schematic illustrations of the legs showing specific areas where a brush massage is to be applied.
Figure 9B:
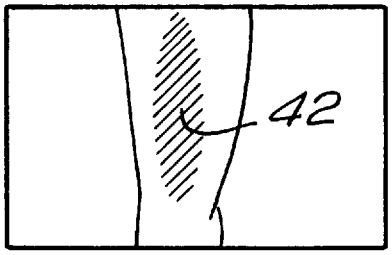
Figure 9C:
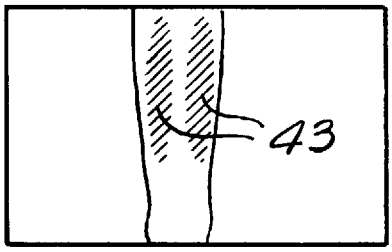

FIGS. 9*a* to 9*c* illustrates the leg and feet areas necessitating massages. As shown in FIG. 9*a* the designated area 41 is the front of the thigh area and the massage is effected from the top part of the area towards the bottom part thereof. This massage is also effected for the right and left legs respectively. The next brush massage is applied to the interior face of the thigh, shown as designated by reference numeral 42 in FIG. 9*b* and it is applied from the top portion of that area to the bottom portion. The front part of the leg is then massaged in the designated area 43 and from below the knee to the top of the ankle.

Figure 10B:
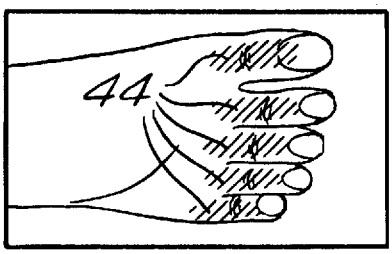
FIGS. 10*a* to 10*e* are schematic illustrations of the feet and portions of the legs showing specific areas where a brush massage is to be applied.
Figure 10C:
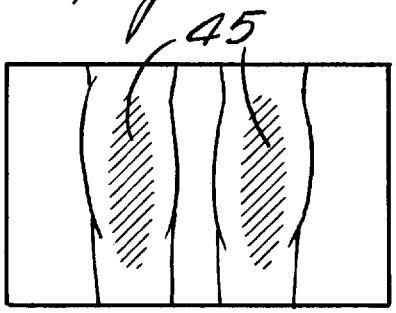
Figure 10D:
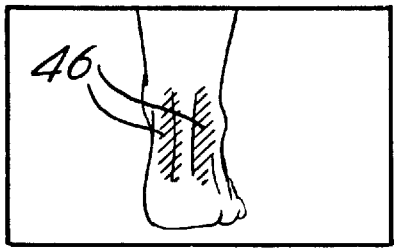
Figure 10A:
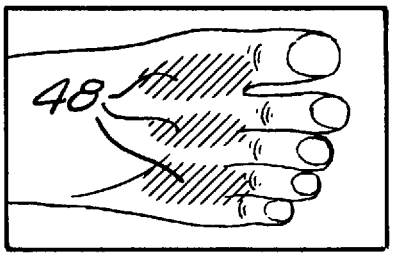
Figure 10E:
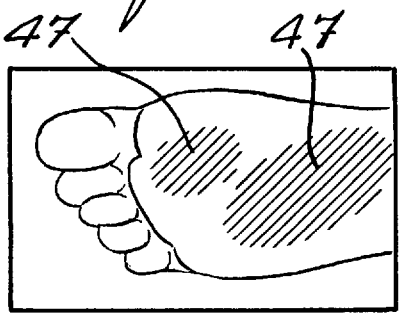

FIGS. 10*a* to 10*e* illustrate the designated areas to massage the feet. Again these massages are effected to the right and left foot and leg respectively. As shown in FIG. 10*a* the designated area 43 are on top of the foot behind the toes. The next designated area 44 as shown in FIG. 10*b* is the top of the toes. FIG. 10*c* illustrates the massage area 45 for the calf of the legs which is performed after the top of the foot has been massaged. FIG. 10*d* illustrates the ankle area 46 whereas FIG. 10*e* illustrates the sole areas 47 of the foot.

It is pointed out that all of the areas illustrated in FIGS. 10*a* to 10*e* are effected for the right foot and leg and then for the left foot and leg, in that order.

It is not intended to limit the present invention specifically to that order of treatment as illustrated by FIGS. 3*a* to 10*e* and that variations thereof are possible. The appended claims define the broad coverage of the method of treating the skin in accordance with the present invention and in accordance with a specific massage procedure and using brushes which are rotated in a clockwise direction during the application of the massage and at designated areas selected in compliance with a network of acupuncture points with the net results being an improvement in blood circulation while simultaneously providing an exfoliation of skin tissue.

I claim:

1. A method of treating the skin by a specific massage procedure using one or more brushes, said method comprising the steps of:

i) providing facial and body massaging brushes having bristles, ii) applying a skin cleansing product to specific designated areas of a person's body and face prior to brush massage, iii) applying a clockwise brush massage to stimulate said specific designated areas of said body and face by said bristles for a predetermined period of time while being subjected to a shower of water, iv) performing said step (iii) in a specific sequence of said designated areas in compliance with a network of acupuncture points, said method improving blood circulation and simultaneously providing an exfoliation of skin tissue, said specific sequence of massage including the following sequential order of said main designated body areas:

a) the hands of the user, b) the head and the neck of the user, c) the shoulders and back of the user, d) the face and the neck of the user, e) the chest and the stomach of the user, f) the arms, g) the legs and the feet of the user, and h) the feet and leg.

2. The method of claim 1 wherein said main designated areas comprise one or more secondary areas sequentially designated for said message.

3. The method of claim 2 wherein said designated body area (b) comprises sequentially the following secondary areas:

b1) the lower back area of the head, b2) the back neck muscles, and b3) the top of the head.

4. The method of claim 2 wherein said designated body area comprises sequentially the following secondary areas:

c1) the top of the shoulder, c2) the top area of the back from a low designated region to an upper designated region, c3) the lower area of the back from an upper designated region to a lower designated region, and c4) the lower portion of the back near the spinal cord region.

5. The method of claim 2 wherein said designated body area (d) comprises sequentially the following secondary areas:

d1) the forehead, d2) the eyes, d3) the temples, d4) the cheeks, d5) the mouth and neck, d6) the underside of the chin, d7) the neck and throat, and d8) the front and sides of the neck.

6. The method of claim 2 wherein said designated body area (f) comprises sequentially the following secondary areas:

f1) the underarm to the elbow, and f2) the forearm.

7. The method of claim 2 wherein said designated body area (g) comprises sequentially the following secondary areas:

g1) the upper thigh from an upper designated region to a lower designated region, g2) an interior region of the thigh from an upper designated region to a lower designated region, and g3) the legs from the knees to the ankles.

8. The method of claim 2 wherein said designated body area (h) comprises sequentially the following secondary areas of the right and left:

h1) the top of the feet, h2) the top of the toes, h3) the calf, and h4) the sole of the feet.

* * * * *